US011305142B2

(12) United States Patent
Senecal et al.

(10) Patent No.: US 11,305,142 B2
(45) Date of Patent: Apr. 19, 2022

(54) END CAP AGENT NOZZLE

(71) Applicant: Carrier Corporation, Palm Beach Gardens, FL (US)

(72) Inventors: Joseph Albert Senecal, Wellesley, MA (US); Paul Guertin, Lincoln, RI (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 45 days.

(21) Appl. No.: 16/242,338

(22) Filed: Jan. 8, 2019

(65) Prior Publication Data

US 2019/0217137 A1 Jul. 18, 2019

Related U.S. Application Data

(60) Provisional application No. 62/616,899, filed on Jan. 12, 2018.

(51) Int. Cl.

| | |
|---|---|
| ***A62C 31/05*** | (2006.01) |
| ***B05B 1/18*** | (2006.01) |
| ***A62C 35/68*** | (2006.01) |
| *A62C 99/00* | (2010.01) |

(52) U.S. Cl.

CPC ..... *A62C 31/05* (2013.01); *A62C 35/68* (2013.01); *B05B 1/185* (2013.01); *A62C 99/0018* (2013.01)

(58) Field of Classification Search

CPC ..... A62C 31/05; A62C 35/68; A62C 99/0018; A62C 99/0081; B05B 1/185; B05B 1/18

USPC ..... 239/548, 556, 557, 566, 567

See application file for complete search history.

(56) References Cited

U.S. PATENT DOCUMENTS

| | | | | | |
|---|---|---|---|---|---|
| 1,400,533 | A | * | 12/1921 | Engel | B05B 1/14 239/559 |
| 1,539,331 | A | * | 5/1925 | Siemann | B05B 1/185 239/559 |
| 1,702,605 | A | * | 2/1929 | Hartman | B05B 1/185 239/559 |
| 1,906,991 | A | * | 5/1933 | McTernan | B05B 1/185 239/559 |
| 2,076,445 | A | * | 4/1937 | Callander | C03B 37/06 239/543 |
| 2,110,044 | A | * | 3/1938 | Jarvis | B05B 1/14 239/251 |
| 2,290,258 | A | * | 7/1942 | Svet | B05B 1/185 239/567 |

(Continued)

FOREIGN PATENT DOCUMENTS

| | | |
|---|---|---|
| CN | 1142404 A | 2/1997 |
| CN | 2406694 | 11/2000 |

(Continued)

OTHER PUBLICATIONS

"Fire Extinguishing Device for Chemical and Petroleum Processing Enterprises", p. 196-198, written by Ye. Ni Ivanov, Mass Publishing House, Jul. 10, 1992. Not in English.

*Primary Examiner* — Jason J Boeckmann

(74) *Attorney, Agent, or Firm* — Carlson, Gaskey & Olds, P.C.

(57) ABSTRACT

A nozzle for a fire suppression system includes a smooth dome having an exterior surface approximating a partial sphere, a cavity within the dome, and a plurality of orifices through the dome providing fluid communication between the cavity and the exterior of the dome. A fire suppression system is also disclosed.

17 Claims, 8 Drawing Sheets

(56) References Cited

U.S. PATENT DOCUMENTS 2,349,449 A * 5/1944 Meador ..... B05B 1/14 239/491
2,743,138 A * 4/1956 Wahlin ..... B05B 15/16 239/597
2,746,792 A * 5/1956 Hough ..... B05B 1/14 239/276
2,933,259 A * 4/1960 Raskin ..... B05B 7/12 239/405
3,081,950 A * 3/1963 Rinkewich ..... B05B 1/1654 239/394
3,095,151 A * 6/1963 Macchesney ..... B05B 1/3026 239/267
3,111,268 A * 11/1963 Beverly ..... E01H 11/00 239/170
3,131,870 A * 5/1964 Henchert ..... B65D 47/148 239/567
3,319,893 A * 5/1967 Caves ..... B05B 1/1636 239/393
3,363,845 A * 1/1968 Pierce ..... F23D 14/58 239/559
3,385,586 A * 5/1968 Kemmetmueller ... C21C 5/4606 239/289
3,452,933 A * 7/1969 Hakluytt ..... F23D 11/104 239/399
3,617,161 A * 11/1971 Polidoro ..... F23D 14/04 431/349
3,623,420 A * 11/1971 Larkfeldt et al. ..... F24F 13/06 454/305
3,713,492 A * 1/1973 Forrest ..... A62C 3/00 169/70
3,719,328 A * 3/1973 Hindman ..... B05B 1/185 239/546
3,730,438 A * 5/1973 Howe ..... B05B 1/14 239/490
3,790,082 A * 2/1974 Pochard ..... B05B 1/083 239/240
3,797,814 A * 3/1974 Rymarchyk, Jr. .... C21C 5/4606 239/132.3
3,913,845 A * 10/1975 Tsuji ..... F02M 61/182 239/556
3,917,443 A * 11/1975 Adams ..... F23D 14/20 431/354
3,995,811 A * 12/1976 Broderick ..... B05B 7/206 239/85
4,056,229 A * 11/1977 Jones ..... B60S 3/044 239/288
4,070,826 A * 1/1978 Stenger ..... F02C 7/222 239/425
4,156,591 A * 5/1979 Anderson ..... F23D 14/64 239/567
4,193,552 A * 3/1980 Ishikawa ..... B05B 1/00 239/533.13
4,249,885 A * 2/1981 Reich ..... F23D 11/101 137/92
D264,617 S * 5/1982 Freeman ..... D23/213
4,365,757 A * 12/1982 Alajos ..... A01G 25/023 239/567
4,372,494 A * 2/1983 Naturel ..... B05B 1/00 239/553.3
4,383,649 A * 5/1983 Reed ..... F23D 11/102 239/429
4,480,793 A * 11/1984 Grande ..... B05B 1/14 239/567
4,491,271 A * 1/1985 Hasenack ..... F23D 11/38 239/1
4,601,428 A * 7/1986 Kurogo ..... F23D 11/105 239/427.3
D285,333 S * 8/1986 Enk ..... D23/213
4,708,293 A * 11/1987 Graziadio ..... B05B 7/0475 239/427
D294,964 S * 3/1988 Mendenhall ..... D23/214
4,802,535 A * 2/1989 Bakke ..... A62C 31/22 169/54
4,809,369 A * 3/1989 Bowden ..... A47K 3/32 4/615
4,819,878 A * 4/1989 Bailey ..... B01D 1/20 239/427
4,890,793 A * 1/1990 Fuglistaller ..... B05B 7/0458 239/290
4,893,752 A * 1/1990 Spink ..... B05B 7/0458 239/427.3
D307,649 S * 5/1990 Henry ..... D23/213
4,984,743 A * 1/1991 Chaddock ..... B05B 3/02 239/559
5,014,790 A * 5/1991 Papavergos ..... A62C 5/024 169/44
5,052,626 A * 10/1991 Wood ..... B05B 1/14 239/567
D325,072 S * 3/1992 Ratnik ..... D23/213
5,100,175 A * 3/1992 Swallow ..... B60B 39/023 239/567
5,170,942 A * 12/1992 Spink ..... B05B 7/0458 239/427
5,176,324 A * 1/1993 Furuse ..... F23D 11/105 239/405
D350,385 S * 9/1994 Mitchell ..... D23/213
D351,642 S * 10/1994 Mitchell ..... D23/213
D351,895 S 10/1994 Fritz et al.
5,368,230 A * 11/1994 Oppenberg ..... B05B 7/0416 239/132.5
5,372,312 A * 12/1994 Vidusek ..... B05B 1/14 239/104
5,452,857 A * 9/1995 Furuse ..... F23D 11/105 239/405
5,596,873 A * 1/1997 Joshi ..... F23R 3/286 60/738
5,603,453 A * 2/1997 Weaver ..... B05B 7/0075 239/8
5,673,859 A * 10/1997 Haruch ..... B05B 1/04 239/434
5,752,657 A * 5/1998 Hogan ..... B05B 3/1021 239/223
5,794,857 A * 8/1998 Chen ..... B01J 8/1827 239/430
5,803,363 A * 9/1998 Matsumura ..... B05B 1/185 239/200
5,839,272 A * 11/1998 Toews ..... F02K 9/52 60/240
5,901,906 A * 5/1999 Bouldin ..... E04H 4/1681 134/167 R
6,010,329 A * 1/2000 Zagoroff ..... B01F 5/0413 126/405
6,012,652 A * 1/2000 Holtan ..... B01J 8/1827 239/430
6,029,746 A * 2/2000 Dodd ..... B08B 9/0433 166/222
D434,053 S 11/2000 Fort et al.
6,189,622 B1 * 2/2001 Audet ..... A62C 31/02 169/16
6,199,566 B1 * 3/2001 Gazewood ..... B08B 9/0433 134/166 C
D445,870 S * 7/2001 Palestrant ..... D23/213
6,463,658 B1 * 10/2002 Larsson ..... B05B 1/185 29/890.142
6,470,980 B1 * 10/2002 Dodd ..... B08B 9/0433 175/340
6,478,239 B2 * 11/2002 Chung ..... F23D 11/102 239/398
6,622,944 B1 * 9/2003 Hurley ..... F23D 11/102 239/426
6,681,498 B2 * 1/2004 Steffan ..... F26B 21/004 206/5.1
7,007,865 B2 * 3/2006 Dodd ..... B05B 1/1672 239/225.1
7,384,005 B1 * 6/2008 Caine ..... B08B 9/093 239/229

(56) References Cited

U.S. PATENT DOCUMENTS

| | | | | |
|---|---|---|---|---|
| 7,578,453 | B1 * | 8/2009 | Wilson | B05B 1/1672 239/391 |
| 7,578,454 | B2 * | 8/2009 | Joo | A62C 31/05 239/488 |
| 7,611,663 | B2 * | 11/2009 | Zulehner | F27D 1/12 266/218 |
| 7,878,419 | B2 * | 2/2011 | Waddelow | A62C 31/05 239/104 |
| 7,992,805 | B2 * | 8/2011 | Chen | B01J 4/002 239/433 |
| 8,181,891 | B2 * | 5/2012 | Ziminsky | F23D 14/48 239/430 |
| 8,469,287 | B1 * | 6/2013 | Lembo, III | A01G 25/06 239/1 |
| 8,695,719 | B2 * | 4/2014 | Retzloff | A62C 37/09 169/37 |
| 8,984,889 | B2 * | 3/2015 | Wilbraham | F23R 3/14 60/737 |
| D734,427 | S * | 7/2015 | Bygbjerg | D23/213 |
| 10,369,579 | B1 * | 8/2019 | Badovick | B05B 7/0483 |
| 10,493,471 | B2 * | 12/2019 | Eurippini | A45D 34/04 |
| 10,576,317 | B2 | 3/2020 | Claessen et al. | |
| 2003/0080215 | A1 * | 5/2003 | Hurley | B05B 7/0892 239/463 |
| 2004/0256118 | A1 * | 12/2004 | Dunster | A62C 31/05 169/54 |
| 2007/0163627 | A1 * | 7/2007 | Lim | B05B 1/20 134/94.1 |
| 2008/0006719 | A1 * | 1/2008 | Clerget | B05B 1/14 239/337 |
| 2016/0325126 | A1 * | 11/2016 | Swift | A62C 35/68 |
| 2017/0007867 | A1 * | 1/2017 | Claessen | A62C 31/03 |
| 2019/0217137 | A1 | 7/2019 | Senecal et al. | |

FOREIGN PATENT DOCUMENTS

| | | | |
|---|---|---|---|
| CN | 2406694 | Y | 11/2000 |
| CN | 2682212 | Y | 3/2005 |
| CN | 201613188 | U | 10/2010 |
| CN | 201922842 | U | 2/2011 |
| CN | 101634013 | | 4/2011 |
| CN | 202154967 | U | 3/2012 |
| CN | 203948774 | U | 11/2014 |
| CN | 204724344 | U | 10/2015 |
| CN | 105963888 | | 9/2016 |
| CN | 106119751 | A | 11/2016 |
| CN | 106267655 | | 1/2017 |
| CN | 106369798 | A | 2/2017 |
| CN | 106422135 | | 2/2017 |
| CN | 205978962 | U | 2/2017 |
| CN | 106669082 | | 5/2017 |
| CN | 206631048 | U | 11/2017 |
| CN | 207745449 | U | 8/2018 |
| EP | 0449823 | B1 | 11/1997 |
| EP | 2316536 | A2 | 5/2011 |
| EP | 2316536 | A3 | 5/2011 |
| JP | 4621337 | | 1/2011 |
| JP | 4621337 | B2 | 1/2011 |
| KR | 200372129 | U | 1/2005 |
| WO | 90/07231 | A1 | 6/1990 |
| WO | 2013/029614 | A2 | 3/2013 |
| WO | 2017/060720 | A1 | 4/2017 |

* cited by examiner

SECTION A-A

SECTION B-B

SECTION C-C

SECTION D-D

END CAP AGENT NOZZLE

CROSS-REFERENCE TO RELATED APPLICATION

This application claims priority to U.S. Provisional Application No. 62/616,899 filed on Jan. 12, 2018.

BACKGROUND

Known fire suppression systems operate by dispersing vaporizable fire suppressing or extinguishing agents throughout a protected space. Such systems typically have one or more pressurized reservoirs of extinguishing agent connected to a network of pipes. The pipes carry the agent, frequently in a liquid state, from the storage location to the protected space, terminating at the walls or ceiling or at through-wall or ceiling positions. The agent is dispersed into the protected space by nozzles connected to the ends of the pipes, projecting agent into the space where it mixes with the air in the space.

A known nozzle design has a cylindrical body perforated around its circumference by lateral orifices. The agent flows into the cylindrical body and is dispersed laterally through the orifices. The nozzle needs to project into the room, and a pipe nipple and elbow fittings may be necessary to install the nozzle in an effective orientation.

SUMMARY

A nozzle for a fire suppression system according to an exemplary embodiment of this disclosure includes among other possible things, a smooth dome having an exterior surface approximating a partial sphere, a cavity within the dome, and a plurality of orifices through the dome providing fluid communication between the cavity and the exterior of the dome.

In a further embodiment of the foregoing nozzle, a generally cylindrical neck section extends from the dome and encloses part of the cavity.

In a further embodiment of any of the foregoing nozzles, an interior surface of the neck section is threaded.

In a further embodiment of any of the foregoing nozzles, the partial sphere is less than half of a sphere.

In a further embodiment of any of the foregoing nozzles, the orifices are approximately cylindrical and have longitudinal axes extending in directions that are approximately perpendicular to the exterior surface of the dome at their respective locations on a first plane.

In a further embodiment of any of the foregoing nozzles, the longitudinal axes are parallel on a second plane that is perpendicular to the first plane.

In a further embodiment of any of the foregoing nozzles, all of the orifices are arranged generally along a straight line extending across the center of the dome such that agent ejected from the nozzle will be ejected across a first arc on a first axis, and across a second arc on a second axis perpendicular to the first axis. The second arc subtends an angle that is less than half as wide as an angle subtended by the first arc.

In a further embodiment of any of the foregoing nozzles, the orifices are approximately cylindrical and arranged generally in a circle, and the orifices are angled with respect to each other such that agent ejected from the nozzle will be ejected in a spiral pattern.

In a further embodiment of any of the foregoing nozzles, a fixture is releasably secured to cover the dome.

In a further embodiment of any of the foregoing nozzles, a frangible fixture is secured to cover the dome.

A fire suppression system according to an exemplary embodiment of this disclosure includes among other possible things, at least one nozzle including a dome having an exterior surface approximating a partial sphere, a cavity within the dome, and a plurality of orifices through the dome providing fluid communication between the cavity and the exterior of the dome. At least one conduit provides a fire suppressant agent to the nozzle.

In a further embodiment of the foregoing system, the exterior surface is constructed to have a substantial thickness and the orifices are approximately cylindrical and have longitudinal axes.

In a further embodiment of any of the foregoing systems, the orifices are arranged in one or more rows, and the longitudinal axis of each orifice is oriented approximately 20° away from any adjacent orifice in the same row.

In a further embodiment of any of the foregoing systems the plurality of orifices are arranged generally in a circle, and the longitudinal axis of each orifice is tilted in a direction tangent to the circle.

In a further embodiment of any of the foregoing systems, an internally threaded cylindrical neck for connection in fluid communication to an end of a pipe.

In a further embodiment of any of the foregoing systems, the plurality of orifices are arranged in at least two parallel rows.

In a further embodiment of any of the foregoing systems, the at least two parallel rows overlap in a direction perpendicular to the rows.

In a further embodiment of any of the foregoing systems, the nozzle is constructed to expel agent received in a liquid state such that the agent is atomized or vaporized when expelled from the nozzle.

Although the different examples have the specific components shown in the illustrations, embodiments of this invention are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
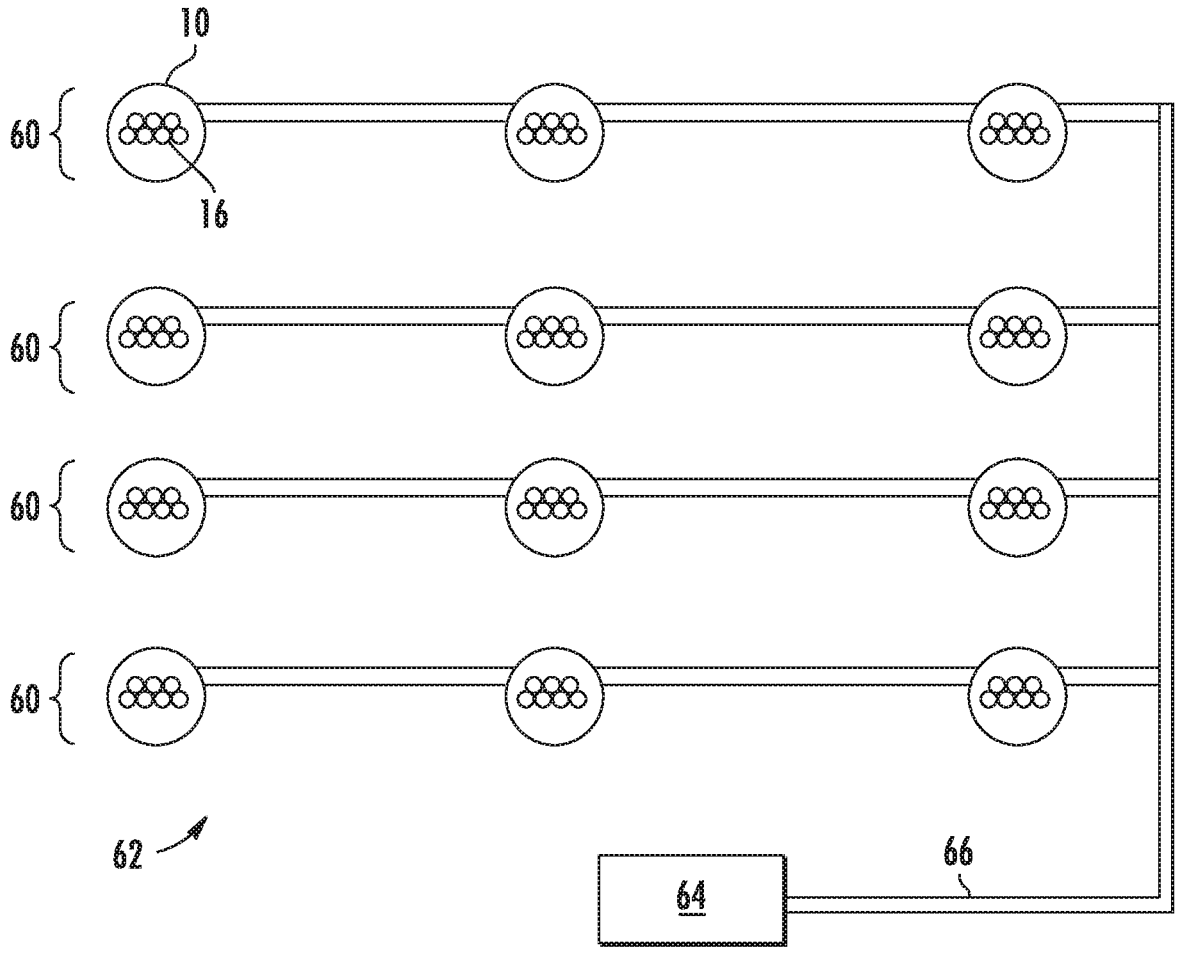
FIG. 1 is a schematic view of an example arrangement of nozzles.

Referring to FIG. 1, an example fire suppression system 62 is shown and includes nozzles 10 for providing fire suppression in a protected space. The nozzles 10 are each connected to pipes 66 leading from an agent reservoir 64. The agent reservoir 64 may be pressurized such that agent which would be gaseous or vaporous at common atmospheric conditions could be stored in a liquid state. Such pressurized liquid agent would then atomize or vaporize after being ejected from the nozzle 10 into a protected space. Alternatively, especially if the agent is water, the reservoir may be a supply system such as plumbing.

The nozzles 10 may be attached in fluid communication with ends of the pipes 66 by threading. The nozzles 10 are arranged in rows 60, and the orifices 16 on each nozzle 10 are arranged generally along straight lines that are parallel to the rows 60. The nozzles 10 in each row 60 are spaced further apart from adjacent nozzles 10 in the same row 60 than the rows 60 are spaced from adjacent rows 60. The example system 62 is disclosed by way of example and other arrangements and relative orientations are possible within the contemplation of this disclosure.

Figure 2:
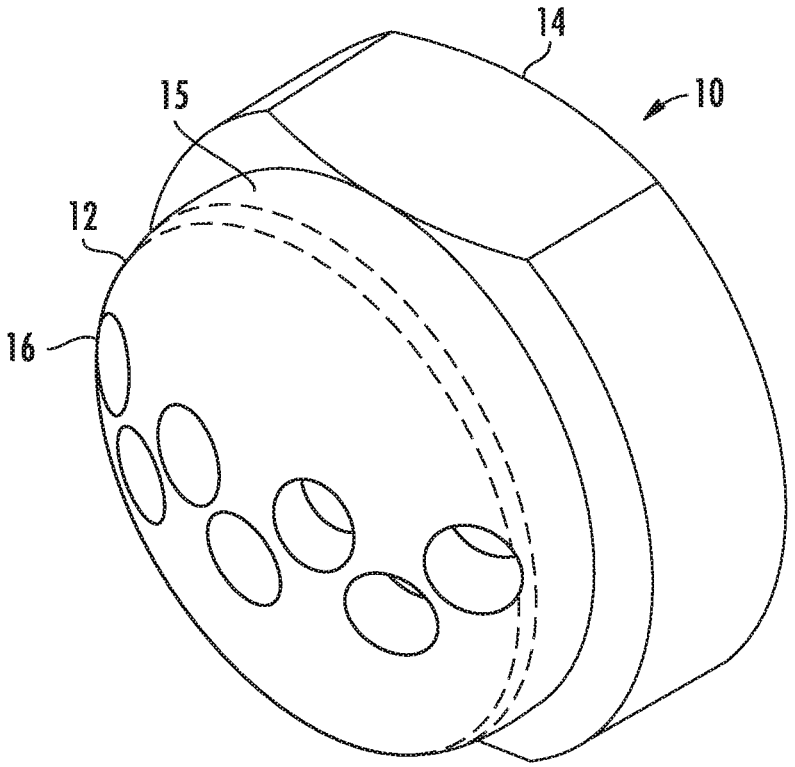
FIG. 2 is an oblique view of a nozzle according to a first embodiment.

Referring to FIG. 2, one of the nozzles 10 for dispersing a fire suppressing agent is shown. The nozzle 10 has a dome 12 and a neck 14 offset from each other by a ring 15. Dome 12 is perforated by orifices 16, which may be arranged generally along a straight line crossing over a center point of the dome 12 as shown. Arranged generally along a straight line in this disclosure is used to describe arrangements including one or more close, parallel rows of orifices 16. It should be noted that the orientation of orifices 16 shown here is only an example, and other arrangements of orifices 16 are expressly contemplated.

Figure 3:
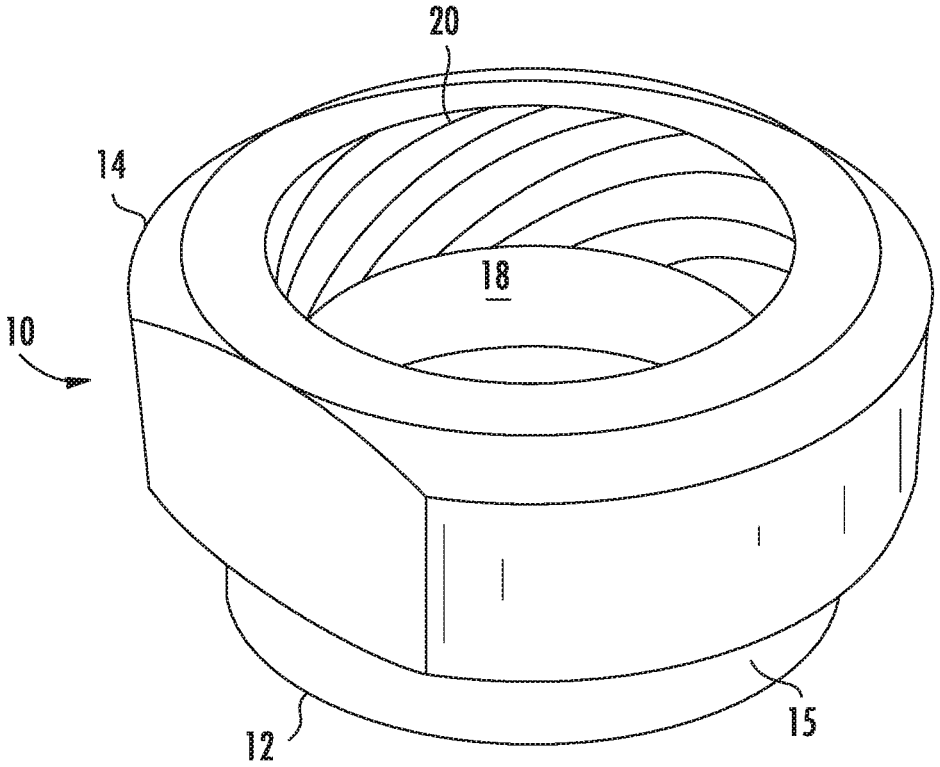
FIG. 3 is a second oblique view of the nozzle.

Turning to FIG. 3 with continued reference to FIG. 2, a cavity 18 is shown disposed inside the nozzle 10. In the disclosed example embodiment, the neck 14 has threads 20 on an inner surface facing the cavity 18. The threads 20 are configured to engage directly with threads on a pipe for delivering fire suppressing agent. Alternatively, the nozzle 10 may be affixed to the pipe by other means, such as welding, brazing, or mechanical coupling constructed for the purpose.

Figure 4A:
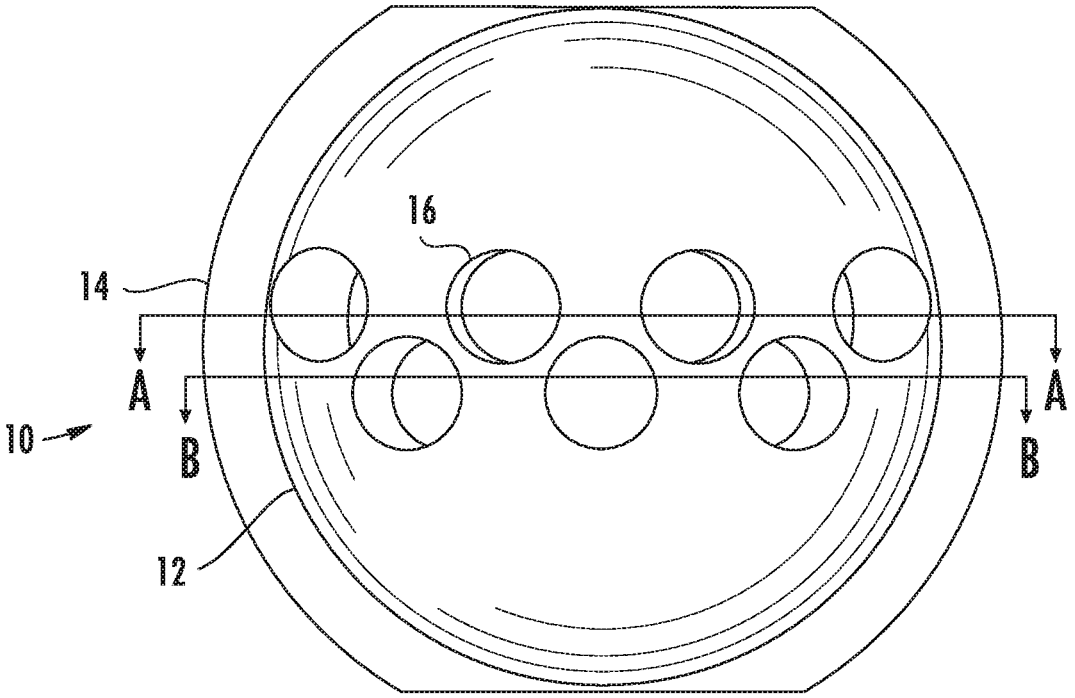
FIG. 4A is a top view of the nozzle.
Figure 4B:
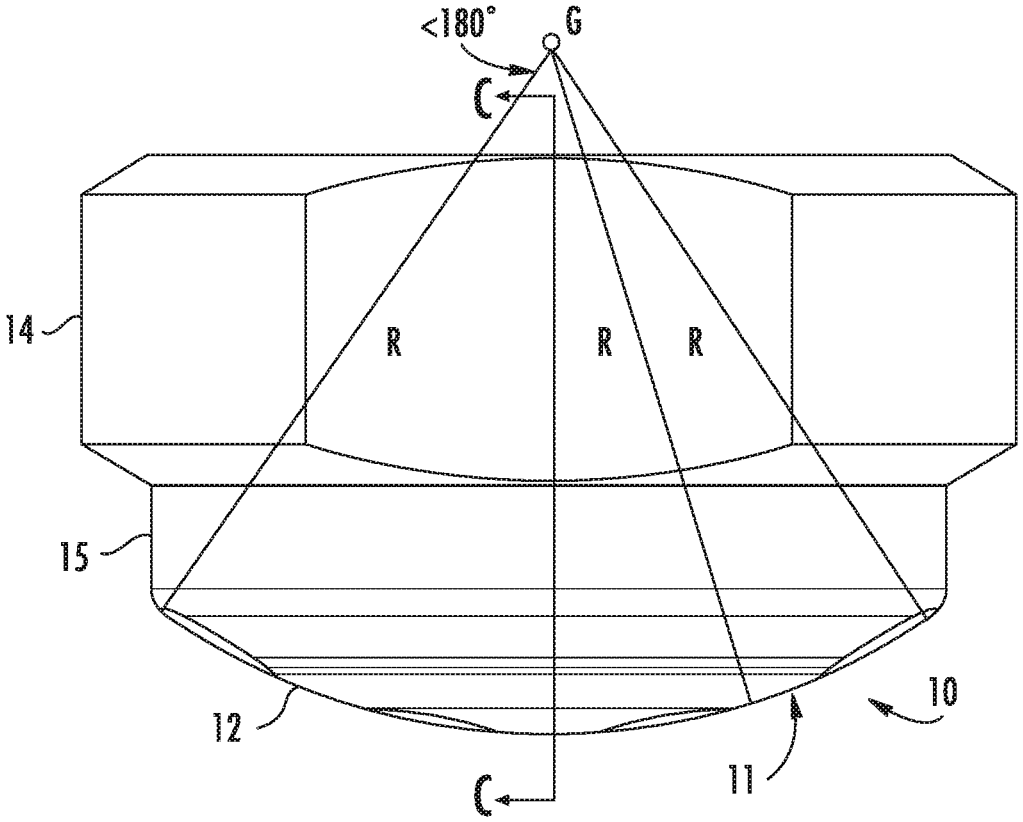
FIG. 4B is a side view of the nozzle.

Referring to FIGS. 4A and 4B, the orifices 16 may be arranged generally along a straight line crossing over a center point of the dome 12. As shown in FIG. 4A specifically, the orifices 16 are generally arranged in parallel rows along section planes A and B. Section plane C, indicated in FIG. 4B, is perpendicular to section planes A and B. The parallel rows overlap in a direction perpendicular to the rows, meaning a line could be drawn parallel to the rows that would intersect an arc of at least one orifice 16 in both rows. In other words, parallel centerlines of the two adjacent rows are separated by a distance that is less than a diameter of the orifices 16. This description is an example only and orifices may be arranged in other patterns suited to the intended manner of agent dispersion.

The dome 12 has the shape of a partial sphere. In other words, the dome 12 according to this embodiment has a smooth rounded exterior surface 11 wherein each point on the surface 11 is at an approximately equal distance R from a given point G. As shown here, the partial sphere of the dome 12 is less than half of a sphere, meaning an arc defined by the dome's 12 exterior surface 11 subtends an angle of less than 180°. For example, the exterior surface 11 of the embodiment depicted here defines an arc subtending a relatively small angle such that the exterior surface 11 is nearly flat. The surface 11 thus generally faces the protected space upon installation.

Figure 5A:
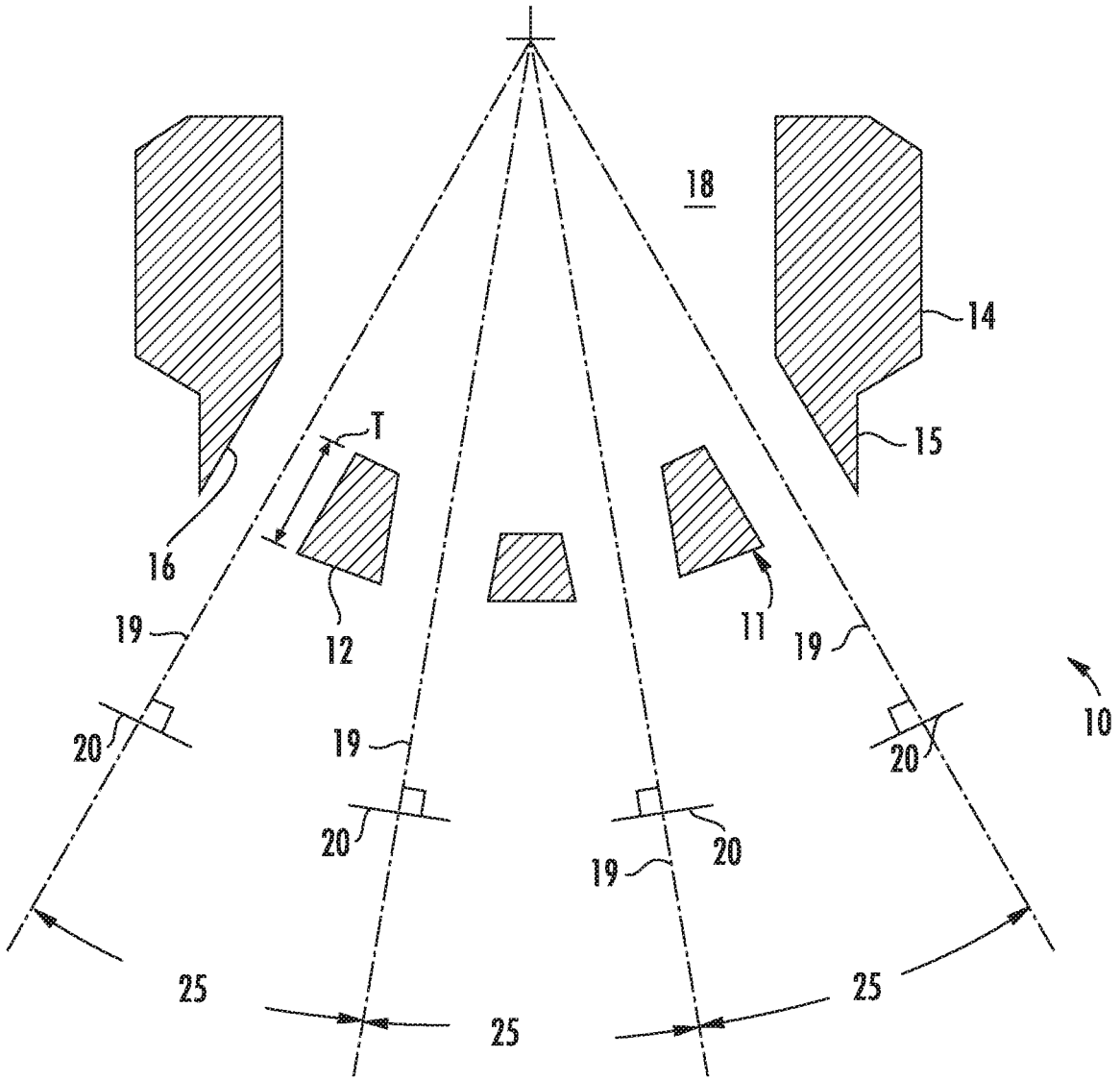
FIG. 5A is a cross section along section A-A of FIG. 4A.
Figure 5B:
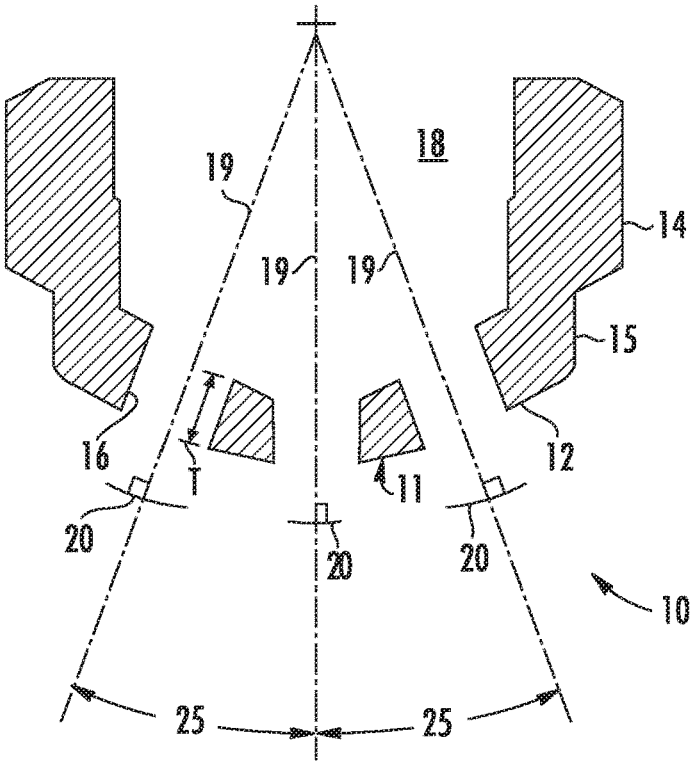
FIG. 5B is a cross section along section B-B of FIG. 4A.

FIGS. 5A and 5B show that the orifices 16 provide fluid communication between the cavity 18 and the exterior surface 11 of the nozzle 10. The orifices 16 are generally cylindrical in shape, and have longitudinal axes 19. The longitudinal axes 19 of the orifices 16 are oriented at angle 25 away from the longitudinal axes 19 of adjacent orifices 16. In one disclosed embodiment, the angle 25 is approximately 20°. The angle 25 is exemplary, and other angles could be equally effective for practicing the disclosed embodiment and are within the contemplation of this disclosure. Further, the longitudinal axes 19 of the orifices 16 are approximately perpendicular to the exterior surface 11 of the dome 12 on section planes A and B. For illustration, tangent lines 20 are tangent to the exterior surface 11 and perpendicular to the longitudinal axes 19 of the orifices 16 on section planes A and B.

Figure 5C:
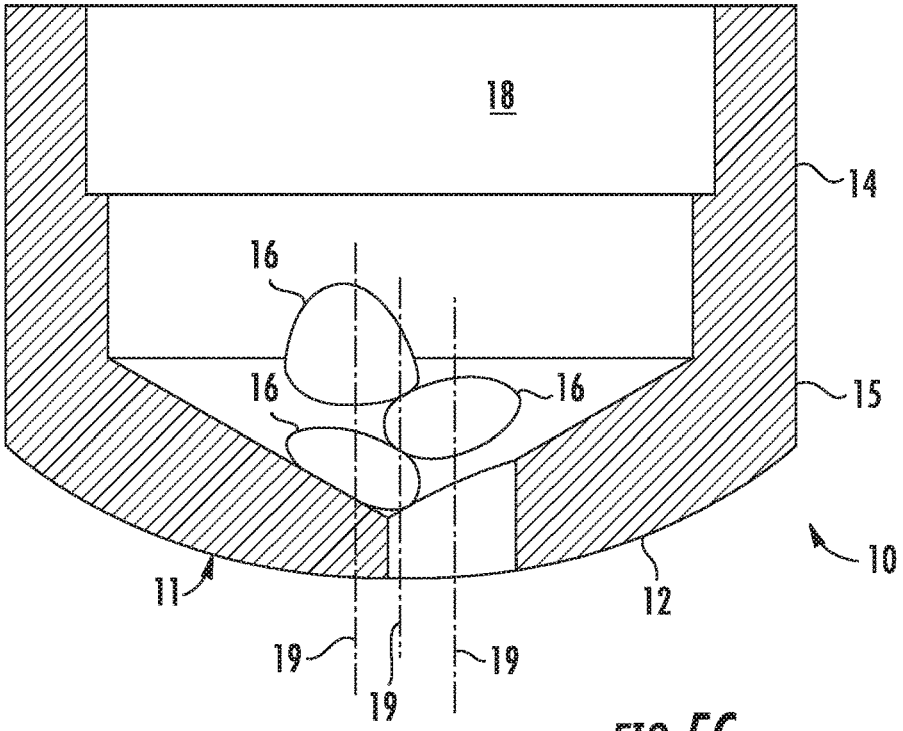
FIG. 5C is a cross section along section C-C of FIG. 4B.

Referring to FIG. 5C, the longitudinal axes 19 of the orifices 16 are parallel with each other and generally axially aligned with the nozzle 10. Thus, on section planes A and B, the longitudinal axes 19 are perpendicular to the exterior surface 11 of the dome 12 at their respective locations, but on section plane C, which is perpendicular to the section planes A and B, the longitudinal axes 19 are parallel to each other and at varying angles relative to the exterior surface 11.

Referring back to FIGS. 5A and 5B, the dome 12 has a substantial thickness T. Here, having a substantial thickness T is utilized to describe that the dome 12 is thicker than a film or membrane. The substantial thickness T enables the orientation of the longitudinal axes 19 of the orifices 16 to direct an angle at which the agent is discharged from the orifices 16.

Figure 6A:
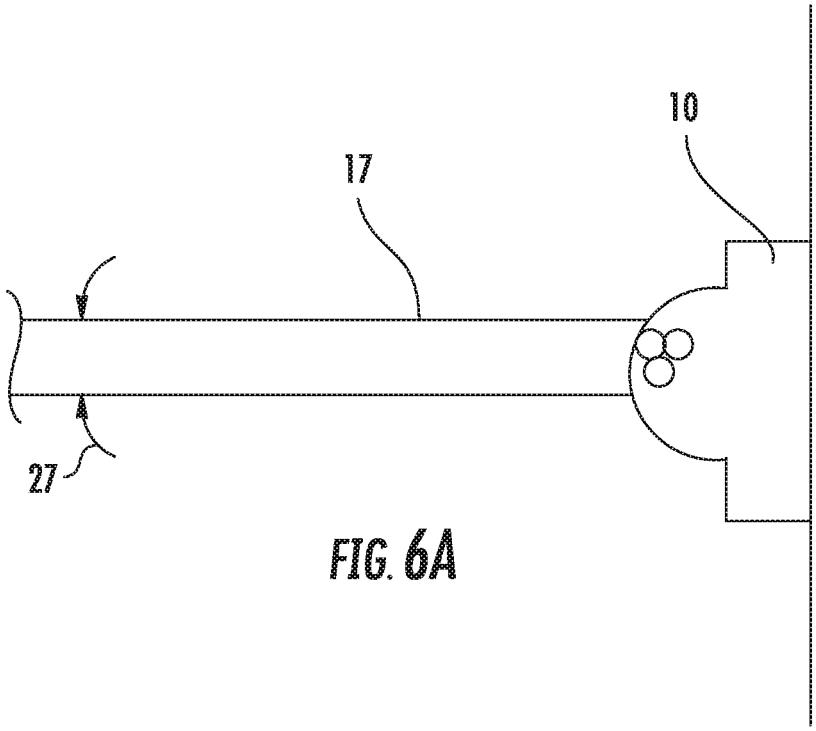
FIG. 6A is a side schematic view of a pattern of ejected fire suppressing agent.
Figure 6B:
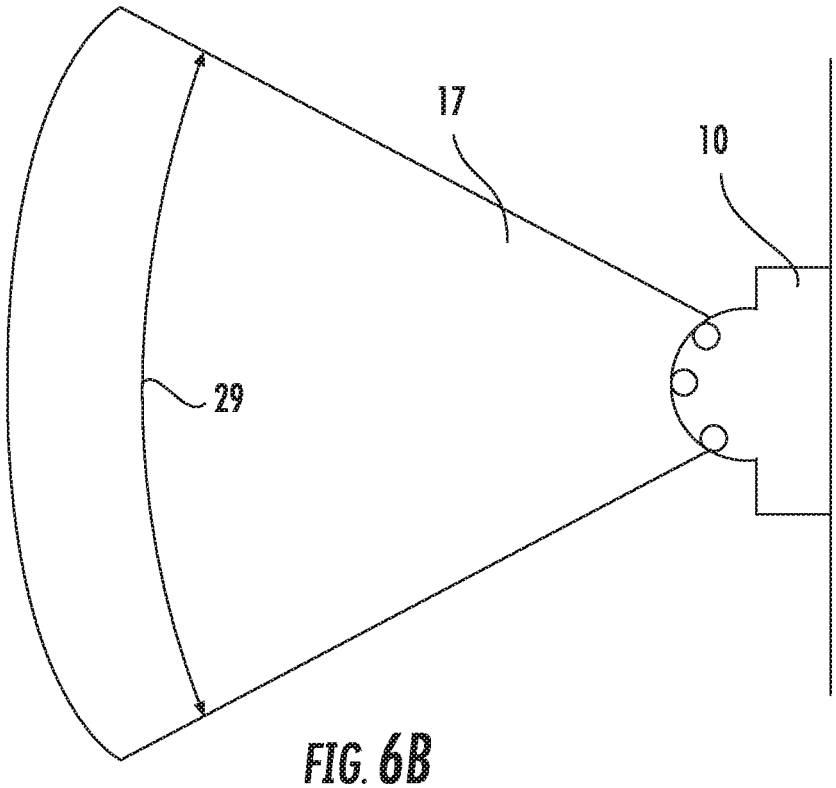
FIG. 6B is a top down schematic view of a pattern of ejected fire suppressing agent.

Referring to the side view and top down view of FIGS. 6A and 6B, a combined effect of the orientation of the orifices 16 as shown in FIGS. 5A through 5C is that agent discharged from the nozzle 10 will be propelled in a flat arcuate shape 17. To an extent that the flat arcuate shape 17 might define a vertical arc from the perspective of FIG. 6A, the vertical arc would subtend an angle 27 significantly smaller than an angle 29 subtended by a horizontal arc that would be visible from the perspective of FIG. 6B. For example, the angle 27 subtended by the vertical arc would be less than half of the angle 29 subtended by the horizontal arc.

The flat arc 17 is complementary to the array of system 62 of FIG. 1. The rows 60 are spaced parallel to the width of the flat arc 17 such that each row 60 of nozzles 10 will quickly provide a sheet-like dispersion of agent in the event of a fire. With multiple rows 60 in parallel and near each other, the array of system 62 can quickly fill a large space with dispersed agent.

Figure 7:
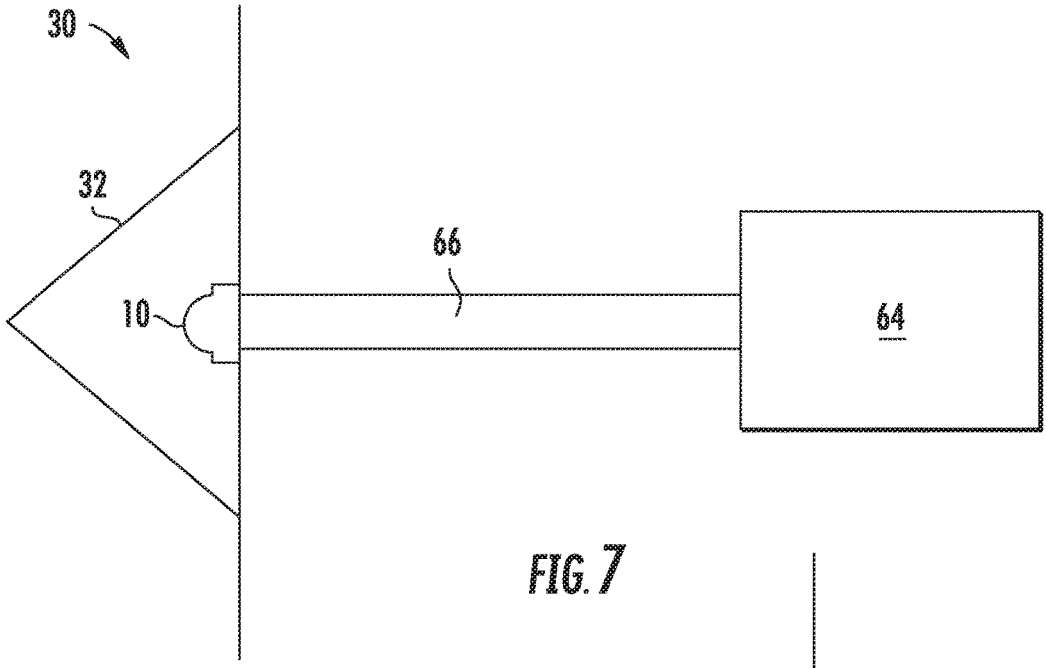
FIG. 7 is a schematic view of an installation of the nozzle behind an anechoic fixture.

FIG. 7 shows an example application for the nozzle 10 in an anechoic chamber. The nozzle 10 is installed near to flush with a wall 30 behind a sound dampening fixture 32. The fixture 32 shown is of pyramidal shape, but the shape of the fixtures 32 is largely irrelevant to the operation of the present disclosure.

The low profile of the nozzle 10 allows it to sit behind the fixture 32 with minimal disruption to the sound properties of the anechoic chamber, while still being connected to a fire suppression system 62. The fixture 32 may be attached to the wall 30 such that, in the event of a fire, fire suppressing agent ejected from the nozzle 10 will either travel through the fixture 32 or cause the fixture 32 to separate from and fall off of the wall 30. In other words, the fixture 32 may be releasably secured over the nozzle 10 to cover the dome 12, or the fixture 32 may be frangible.

Figure 8:
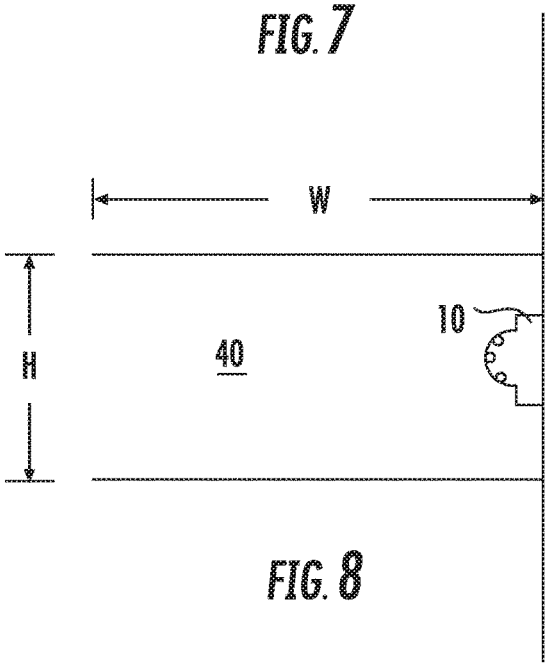
FIG. 8 is a schematic view of another installation embodiment for the nozzle.

FIG. 8 shows another example application for the nozzle 10 in a confined space 40. The confined space 40 may be, for example, a space above a drop ceiling or a subfloor in a data center. The low profile of the nozzle 10 allows it to be installed in confined spaces 40 with relative ease, and where the flat arc 17 dispersal of agent may be useful in providing fire suppression in spaces with width W significantly greater than their height H.

Figure 9:
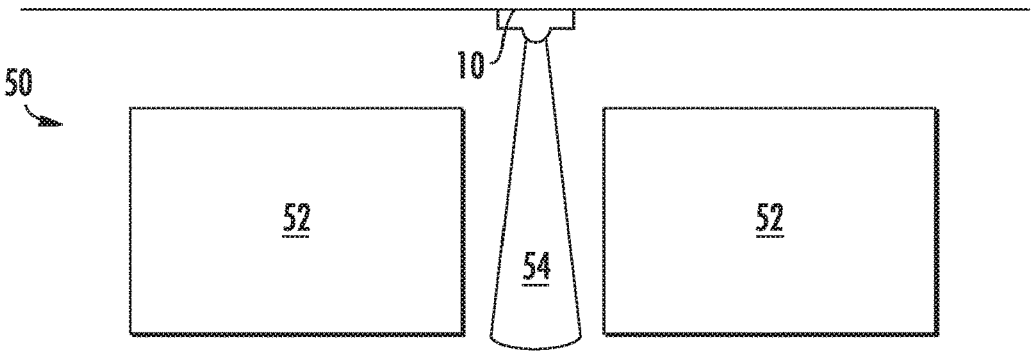
FIG. 9 is a schematic view of a third installation embodiment for the nozzle.

Another example application for the nozzle 10 is in a computer lab 50, schematically shown in FIG. 9. Computer labs 50 frequently contain sensitive computer equipment 52 that may be damaged by direct splatter of liquid fire suppressing agent. The nozzle 10 can be configured to eject agent in a relatively narrow arc or jet 54 into areas between equipment 52 without spraying directly onto the equipment 52.

Figure 10A:
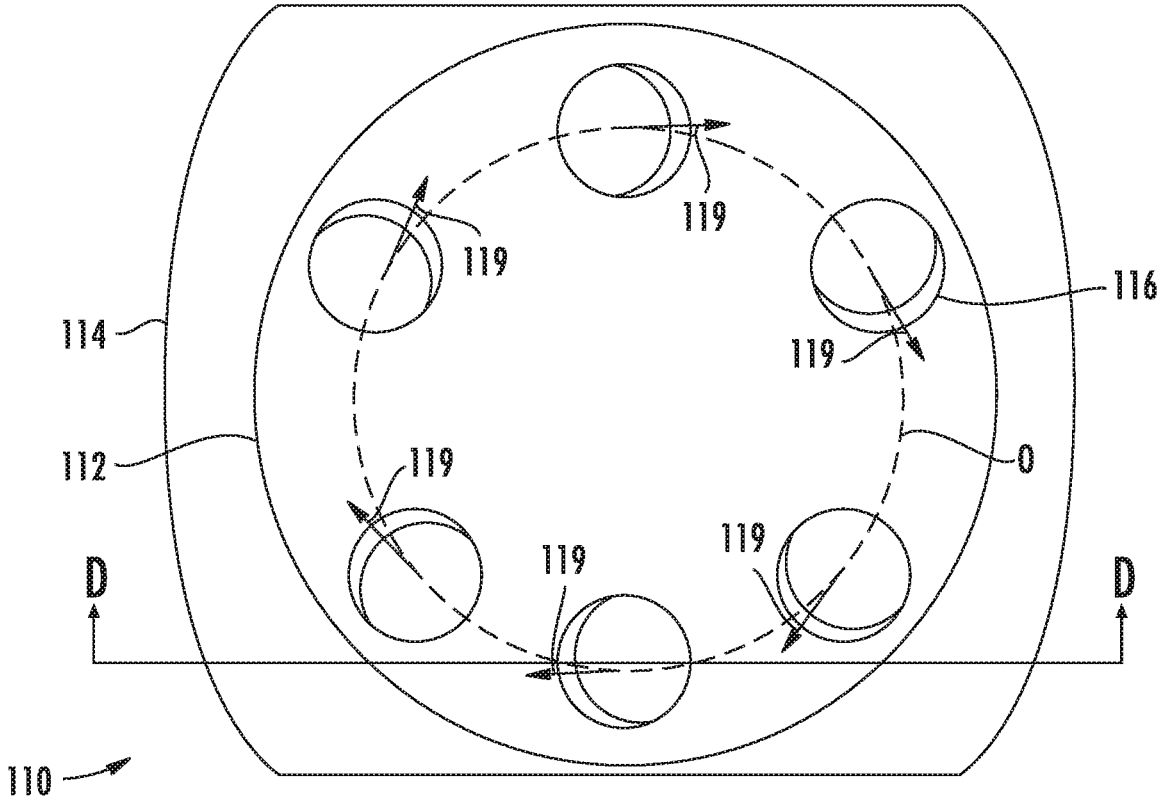
FIG. 10A is a top view of another nozzle embodiment.
Figure 10B:
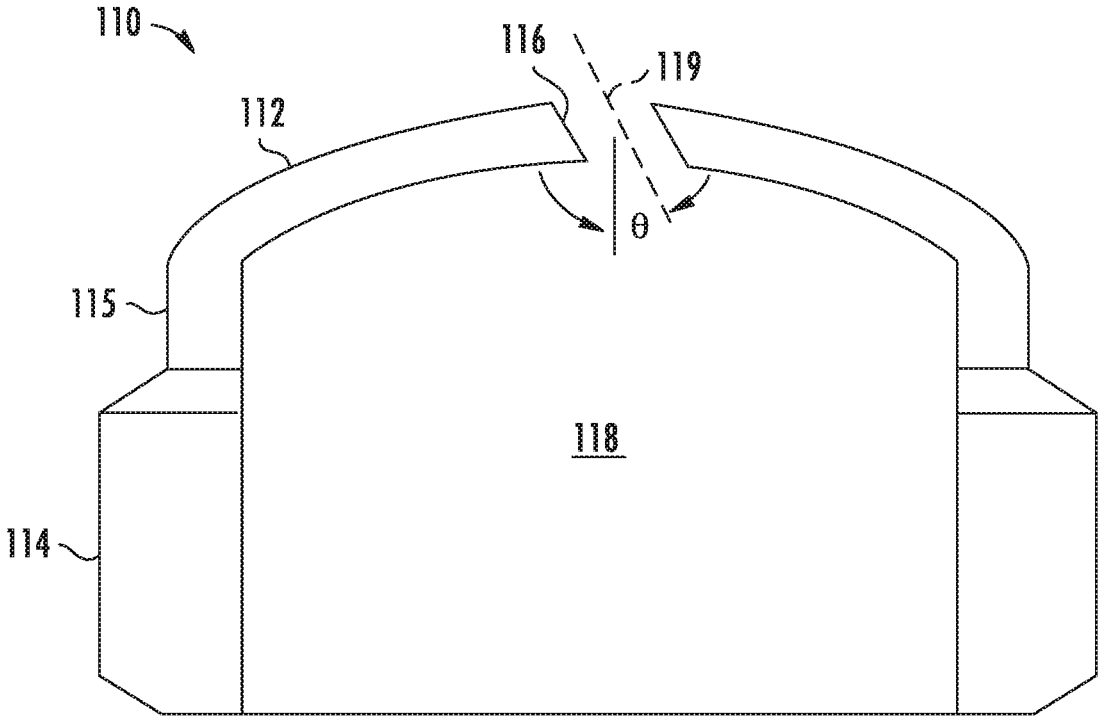
FIG. 10B is a cross sectional view along section D-D of FIG. 10A.

FIGS. 10A and 10B show another nozzle 110 embodiment. The nozzle 110 has a dome 112, a neck 114, a ring 115, a cavity 118, and orifices 116 arranged generally in a circle o. Longitudinal axes 119 of the orifices 116 are tilted by an angle Θ in directions tangent to the circle o. The tilted orifices 116 will eject agent in a spiral, which in some applications will result in relatively quiet operation of the fire suppression system. A quiet fire suppression system may be important in applications such as data centers, where spinning data discs may be sensitive to percussive disturbances. Spiral ejection of agent may also promote spiral air circulation, which can facilitate dispersion of agent throughout protected spaces.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A nozzle for a fire suppression system, comprising:

a smooth dome having an exterior surface approximating a partial sphere wherein the partial sphere is less than half of a sphere;

a cavity within the dome; and a plurality of orifices through the partial sphere of the dome providing fluid communication between the cavity and the exterior of the dome;

wherein the plurality of orifices are arranged in least two parallel rows of orifices, each row includes at least three orifices, the orifices in a first one of the rows are each intersected by a reference straight line extending across the center of the dome, the orifices in a second one of the rows are each intersected by the line, a majority portion of an area of each orifice in the first one of the rows is on a first side of the line, a remaining portion of the area of each orifice in the first one of the rows is on a second side of the line, a majority of an area of each orifice in the second one of the rows is on the second side of the line, a remaining portion of the area of each orifice in the second one of the rows is on the first side of the line, the nozzle is configured such that agent ejected from the nozzle will be ejected in a flat arcuate shape having a first arc and a second arc, the first arc is oriented along the line, the second arc is oriented perpendicular to the line, and the second arc subtends an angle that is less than half as wide as an angle subtended by the first arc.

2. The nozzle of claim 1, further comprising a generally cylindrical neck section extending from the dome and enclosing part of the cavity.

3. The nozzle of claim 2, wherein an interior surface of the neck section is threaded.

4. The nozzle of claim 1, wherein the orifices are approximately cylindrical and each have a longitudinal axis extending in a direction that is approximately perpendicular to a plane tangential to the exterior surface of the dome at the locations of the orifice.

5. The nozzle of claim 4, wherein the longitudinal axes are parallel on a plane that is perpendicular to the straight line.

6. The nozzle of claim 1, wherein a fixture is releasably secured to cover the dome, the fixture being configured to release to uncover the dome in response to agent being ejected from the nozzle.

7. The nozzle of claim 1, wherein a frangible fixture is secured to cover the dome, the fixture being configured to break to uncover the dome in response to agent being ejected from the nozzle.

8. The nozzle of claim 4, wherein the longitudinal axis of each orifice is oriented approximately 20° away from each immediately adjacent orifice in the same row.

9. The nozzle of claim 1, wherein a parallel centerline of the first one of the rows is on the first side of the line and a parallel centerline of the second one of the rows is on the second side of the line.

10. A fire suppression system comprising:

at least one nozzle including:

a dome having an exterior surface approximating a partial sphere;

a cavity within the dome; and a plurality of orifices through the dome providing fluid communication between the cavity and the exterior of the dome;

wherein the orifices are approximately cylindrical and each have a longitudinal axis extending in a directions that is approximately perpendicular to a plane tangential to the exterior surface of the dome at the locations of the orifice, the orifices are arranged in at least two parallel rows each including at least three orifices, the orifices in a first one of the rows are each intersected by a reference straight line extending across the center of the dome, the orifices in a second one of the rows are each intersected by the line, a majority portion of an area of each orifice in the first one of the rows is on a first side of the line, a remaining portion of the area of each orifice in the first one of the rows is on a second side of the line, a majority of an area of each orifice in the second one of the rows is on the second side of the line, a remaining portion of the area of each orifice in the second one of the rows is on the first side of the line, and the longitudinal axis of each orifice is oriented approximately 20° away from each immediately adjacent orifice in the same row; and at least one conduit providing a fire suppressant agent to the nozzle.

11. The system of claim 10, having an internally threaded cylindrical neck for connection in fluid communication to an end of a pipe.

12. The system of claim 10, wherein the nozzle is constructed to expel agent received in a liquid state such that the agent is atomized or vaporized when expelled from the nozzle.

13. The system of claim 10, wherein the at least one conduit is in fluid communication with a reservoir that is configured to store the fire suppressant agent, wherein the fire suppressant agent is stored in the reservoir in a liquid state, and the fire suppressant agent is vaporized after being ejected from the nozzle.

14. The system of claim 10, wherein the nozzle is arranged in an anechoic chamber.

15. The system of claim 10, wherein the nozzle is installed in a confined space.

16. The system of claim 10, wherein the nozzle is configured such that agent ejected from the nozzle will be ejected in a flat arcuate shape having a first arc and a second arc, wherein the first arc is oriented along the line and the second arc is oriented perpendicular to the line, and wherein the second arc subtends an angle that is less than half as wide as an angle subtended by the first arc.

17. The system of claim 10, wherein a parallel centerline of the first one of the rows is on the first side of the line and a parallel centerline of the second one of the rows is on the second side of the line.

* * * * *